US006880371B2

(12) United States Patent
Huang

(10) Patent No.: US 6,880,371 B2
(45) Date of Patent: Apr. 19, 2005

(54) CHANGEABLE COMBINATION LOCK

(76) Inventor: Fu-Chuan Huang, 1F., No. 18, Sec, 1, Chung Hsin Rd., Wu Ku Hsiang, Taipei County (TW)

( * ) Notice: Subject to any disclaimer, the term of this patent is extended or adjusted under 35 U.S.C. 154(b) by 0 days.

(21) Appl. No.: 09/971,939

(22) Filed: Oct. 9, 2001

(65) Prior Publication Data

US 2003/0066319 A1 Apr. 10, 2003

(51) Int. Cl.[7] ..... E05B 37/02
(52) U.S. Cl. ..... 70/28; 70/312
(58) Field of Search ..... 70/22, 24–29, 70/312, 315–317

(56) References Cited

U.S. PATENT DOCUMENTS 901,972 A * 10/1908 Kone
1,205,781 A * 11/1916 Pirog
4,354,366 A * 10/1982 Bako ..... 703/312
4,610,152 A * 9/1986 Duringer ..... 70/30
5,406,811 A * 4/1995 Nakai ..... 70/26
5,924,313 A * 7/1999 Kuo ..... 70/26
5,934,120 A * 8/1999 Kuo ..... 70/312
6,209,368 B1 * 4/2001 Lee ..... 70/312
6,386,005 B1 * 5/2002 Kuo ..... 70/28

* cited by examiner

*Primary Examiner*—Lloyd A. Gall
(74) *Attorney, Agent, or Firm*—Troxell Law Office, PLLC

(57) ABSTRACT

The present invention relates to a changeable combination lock disposed with a lock body. A lock bolt is disposed inside the lock body. More than one digit wheel is sleeved on the lock bolt. One end of the lock body is disposed with a retaining ring. A notch is on the retaining ring. A mark is disposed on the surface of the retaining ring for fitting in with the notch. An actuator and a retaining member are disposed on the retaining ring. When in use, a set of combination is decided and the mark on the retaining ring is aligned with the combination so that a lock bar inserts into a lock hole, therefore, the combination can be changed according to the need for preventing the intruder from easily unlocking the lock.

1 Claim, 6 Drawing Sheets

CHANGEABLE COMBINATION LOCK

BACKGROUND OF THE INVENTION

1) Field of the Invention

The present invention relates to a changeable combination lock, a structure that allows the combination to be changed according to the need and prevents the intruder from easily unlocking the lock so the user can obtain more protection.

2) Description of the Prior Art

Accordingly, the general combination lock of the prior art comprises a male lock body, a female lock body, a sealing ring, a retaining body, a ring sleeve, a digit disc and a lock chain ring; wherein the male lock body has several retaining teeth disposed on the upper end surface of a sleeve rod thereof; a concave portion is defined between two retaining teeth; a rectangular locating portion is disposed at one end of the sleeve rod of the said male lock body; a flange is disposed in a proper area of the said locating portion; a receiving segment is disposed on the adjacent side of the location portion; a female lock body is a rod body disposed with a groove and a stop block with a through hole is disposed at one end thereof; a notch is connectively disposed opposite the upper aspect of the through hole; another receiving segment is disposed at another end of the rod body of the said female lock body; there are two sealing rings and the outer rim of one of them is disposed with a projecting alignment block in a proper area; a communicated hole is disposed among several digit discs; a notch is disposed in a proper area of the communicated hole; digits are carved on the outer periphery of the digit disc; a rectangular pass-through hole is disposed on the inner wall surface of the said sealing ring; a concave hole is disposed in a proper area on the inner periphery of the digit disc; a round hole is disposed between two retaining bodies and a retaining block is disposed in a proper area at one end surface thereof; two ring sleeves have receiving chambers at one end thereof; a vertical hole and a horizontal hole are respectively disposed inside the ring sleeve; the vertical hole and the horizontal hole are communicated; a notch is disposed at the upper end of the horizontal hole; the inside of a locating sleeve is a square through hole; a locating block fitting in with the concave hole on the digit disc is disposed in a proper area on the outer rim thereof; a lock chain ring is a chain ring with a proper strength and has two retaining segments disposed at two ends.

Thereby, after the locating sleeve is sleeved at one end of the male lock body, the sealing ring, a resilient element, the retaining body and the ring sleeve are sleeved on sequentially; one end of the lock chain ring is inserted into the vertical hole of the ring sleeve; through the push of the resilient element, the retaining block of the retaining body and the retaining segment mutually engage so as to position the male lock body, the sealing ring, the retaining body, the ring sleeve and one end of the lock chain ring; after that, the locating sleeve is sleeved onto the rod body of the female lock body, then, several teeth discs, the sealing ring, the resilient element, the retaining body and the ring sleeve are mounted on the female lock body; the other end of the lock chain ring is inserted into the vertical hole; through the push of the resilient element, the retaining block engages in the retaining segment of the lock chain ring. However, since the said combination lock can only set one combination for unlocking the lock and the combination is set before the product is shipped from the factory, it is very easy for the outsiders to guess the combination and further unlock the lock.

In view of the mentioned reasons, the inventor of the present invention, in order to improve the abovementioned shortcomings of the device structure of the prior art, strove to research and experiment for a long term, finally developed and designed the present invention of a changeable combination lock.

SUMMARY OF THE INVENTION

The primary objective of the present invention is to provide a changeable combination lock with a design permitting the installer to easily change the combination for unlocking the lock and further achieving the objective of being a simple and practical invention for easy access.

Another objective of the present invention is to provide a combination lock disposed with a lock body; a lock bolt is disposed in the said lock body; more than one digit wheels set are sleeved onto the lock bolt; a retaining ring is disposed at one end of the said lock body; a notch is on the said retaining ring; a mark is carved on the surface of the retaining ring for matching with the notch; an actuator and a retaining member are disposed on the said retaining ring; when in use, a set of combination is made according to the need by rotating the digit wheel to align the mark on the retaining ring with the said combination in a straight line; then a lock bar inserts into a lock hole to make the lock bolt pressed by the lock bar move toward the digit wheel sets; the cooperation of the actuator and the retaining member disengages the actuating member from the digit wheel sets; therefore, the action of changing the combination is accomplished; contrarily, it is only necessary to rotate the digit wheel to the preset combination to align with the mark on the retaining ring in a straight line, thereby the actuating member resumes to the original position; at the same time, the lock bolt moves from the notch on the retaining ring toward the lock hole to disengage the lock bolt retained on the lock bar from the lock bar; therefore, different from the combination lock of the prior art having only one set of combination, the user can continuously change the combination according to the need and further prevent the outsider from easily unlocking the lock.

To enable a further understanding of the objective, the configuration, the device features and the efficiency of the present invention, the brief description of the drawings below is followed by the detailed description of the preferred embodiment.

DETAILED DESCRIPTION OF THE PREFERRED EMBODIMENTS

Figure 1:
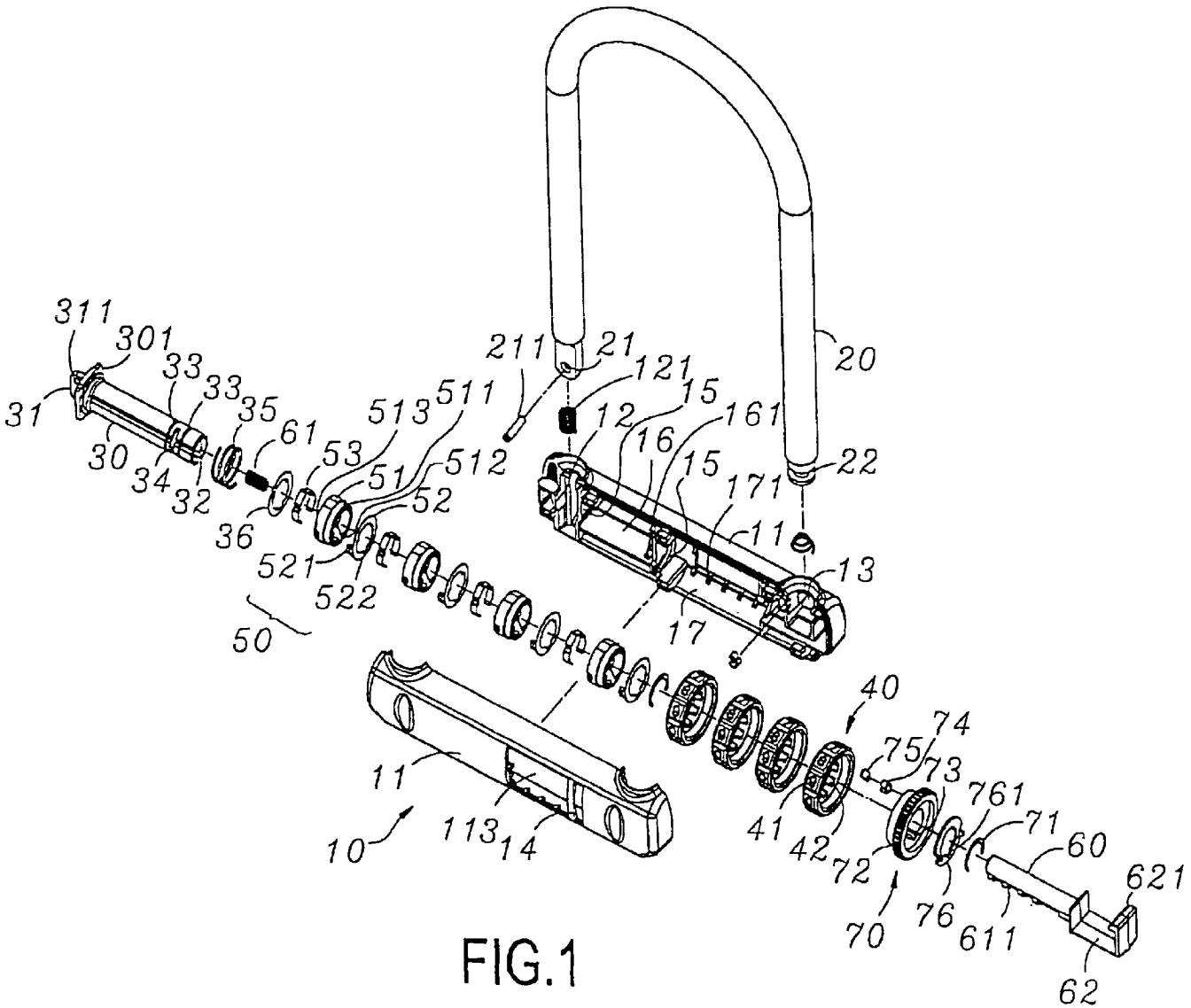
FIG. 1 is an exploded and pictorial drawing of the present invention.
Figure 2:
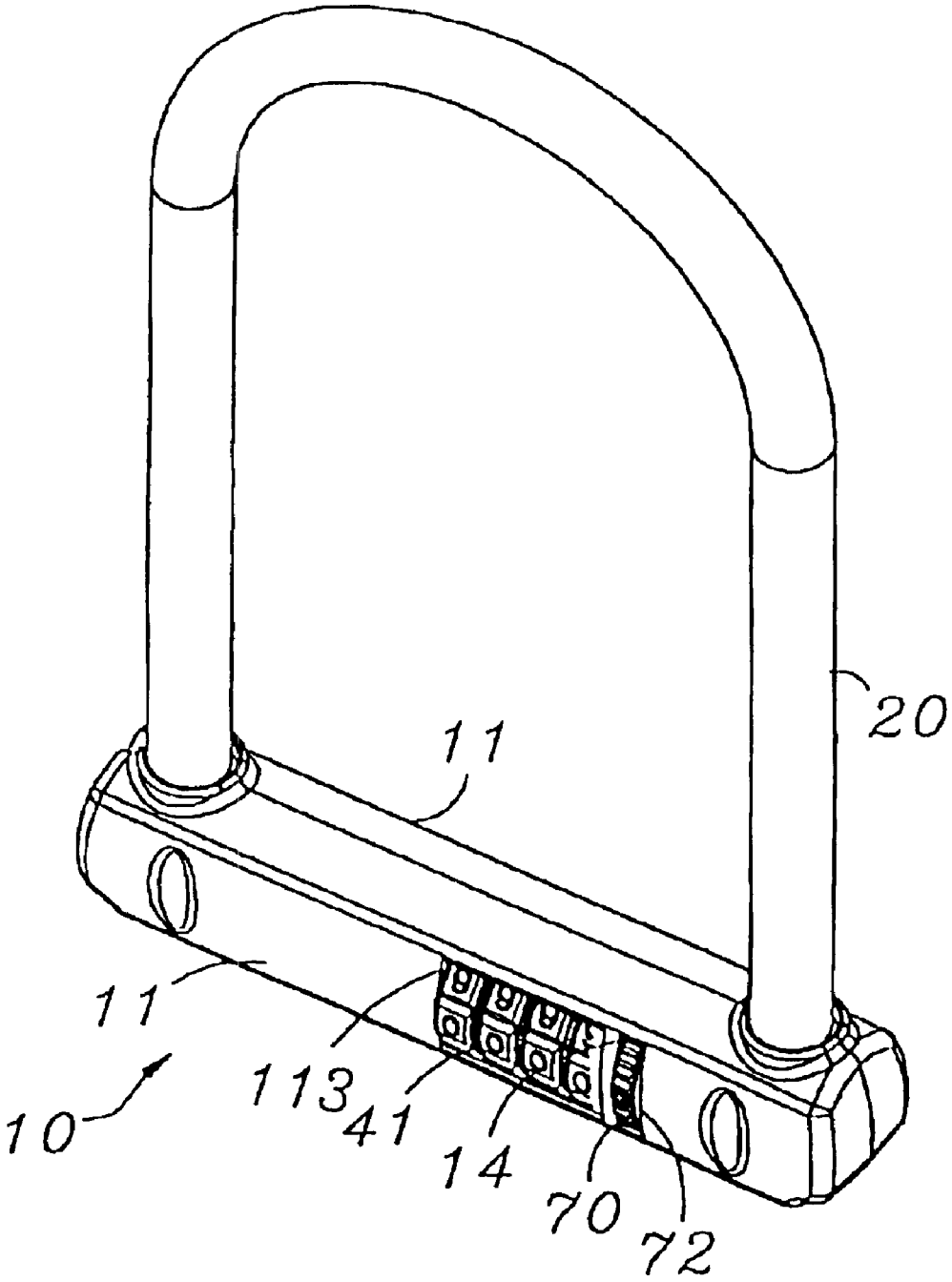
FIG. 2 is a schematic drawing of the pictorial and external view of the present invention.

Referring to FIGS. 1 and 2, the present invention is a changeable combination lock disposed with a lock body (10); the said lock body (10) is comprised by two case bodies (11) in the same shape, as shown in FIG. 2; two ends of the said lock body (10) are respectively disposed with two lock holes (12, 13); wherein the lock hole (13) communicates with a concave slot (14) situated at the said end rim of the said lock body; a lock bar (20) fitting in with the lock hole (12) is disposed on the said lock body (10) and is a U-shaped bar in this embodiment (for those skilled in this art, other element can be used for replacement); one end of the said lock bar (20) is disposed with a pivot joint hole (21) permitting an insert pin (211) to insert into the pivot joint hole (21) and to be pivotally jointed in the lock hole (12) communicating with the lock body (10); a resilient element (121) is disposed in the said lock hole (12), it is a spring in this embodiment; one end of the resilient element (121) pushes against the closed end of the lock hole (12); the other end thereof presses against the end rim of the lock bar (20) inserted in the lock hole (12); the other end of the said lock bar (20) is disposed with a concave and annular insert groove (22).

First and second spaces (16, 17) adjacent to each other and divided by a partition (15) are disposed between two lock holes (12, 13) of the lock body (10); the ends of the said first and second spaces (16, 17), not adjacent to each other, are respectively adjacent to the lock holes (12, 13); wherein, one end of the first space (16) adjacent to the second space (17) is disposed with an opposite column cotter (161); a sleeve (30) situated over the first and second spaces (16, 17) is fixedly mounted on the column cotter (161); a stop plate (301) is disposed at one end of the sleeve (30); the other end of the stop plate (301) connects with a convex ear (31); a through hole (311) is disposed on the convex ear (31) for the column cotter (161) to insert; the other end of the said sleeve (30) is adjacent to the lock hole (13); an axially extending open slot (32) passing through the inside thereof is disposed on the said sleeve (30); in the area adjacent to the lock hole (13), an adjacent annular groove (33) is disposed in a certain distance on the sleeve (30); an opening (34) radially extending but not through the whole sleeve (30) is disposed between the annular grooves (33).

A resilient element (35) is sleeved on the said sleeve (30) and it is a spring in this embodiment; one end of the said resilient element (35) presses against onto the stop plate (301), the other end is attached by a bushing (36) sleeved on the said sleeve (30); more than one digit wheels (40) are sleeved on the sleeve (30); the said digit wheels (40) are installed in the second space (17) adjacent to the lock hole (13); a locating partition (171) capable of locating the digit wheel (40) is disposed on the inner wall of the said second space (17) for fixing the digit wheel (40) at its position and keeping it from deviating; the surfaces of the digit wheels (40) are disposed with consecutive digits (41), they are digits 0 to 9 in this embodiment; the side rims of the said digit wheels (40) just protrude in the fitting lock hole (113) on the lock body (10) for facilitating the user to rotate; a concave groove (42) is disposed respectively in the opposite area toward each digit in the digit wheel (40); a set of actuating members (50) are disposed respectively in the said digit wheels (40); the actuating members (50) are controlled by the digit wheels (40) for setting: a locating seat (51) is disposed on the said actuating member (50); the said locating seats (51) are respectively clamped between the sleeve (30) and the digit wheels (40); one end of the said locating seat (51) is disposed with a flange (511) extending axially inwardly; the said flanges (511) are disposed respectively with a slide slot (512) extending axially; a live ring (52) is respectively attached on the said flanges (511); a resilient retainer (521 )tightly attached onto the surface of the flange (511) is disposed on the said live rings (52); a concave opening (522) aligned with the slide slot (512) is disposed on the said live rings (52); a locating point (513) is disposed on one end surface on the said locating seats (51); inside the said end of the said locating seats (51), a ring retainer (53) in an open form is disposed for the limiting function of the rotating locating seat (51).

A lock bolt (60) is inserted at the end in an open form of the said sleeve (30); a locating step (611) fitting in with the digit wheel (40)is disposed on the said lock bolt (60); the said locating step (611) protrudes outwards from the inside of the opening slot (32) of the sleeve (30); a resilient element (61) is pressed against one end of the said lock bolt (60) sleeved on the sleeve (30) and it is a spring in this embodiment; the other end of the resilient element (61) pushes against the inside of a closed end of the sleeve (30); the other end of the said lock bolt (60) is disposed with a retainer member (62) extending into the lock hole (13); a retaining hook (621) is disposed at the free end of the said retaining member (62); the said retaining hook (621) just retains on the insert slot (22) of the lock bar (20); a retaining ring (70) partially projecting in the slot hole (14) of the lock body (10) is disposed in the adjacent area between the said second space (17) and the lock hole (13); through the clamping of a C-shaped clamp (71) inserted in the annular slot (33) of the sleeve (30), the said retaining ring (70) is sleeved on the sleeve (30); a mark (72) is disposed on the periphery surface of the said retaining ring (70); a notch (73) corresponding to the said mark (72) and extending axially is disposed in the said retaining ring (70); an actuating member (74) inserted on the inner lateral rim of the retaining ring (70) is disposed on the side of the retaining ring (70) facing the digit wheel (40); a live retaining member (75) is disposed on the retaining ring (70) to position the said actuating member (74) within the inner lateral rim of the retaining ring (70); a washer (76) is inserted in the said retaining ring (70); a concave opening (761) aligned with the notch (73) is disposed on the said washer (76).

Figure 3:
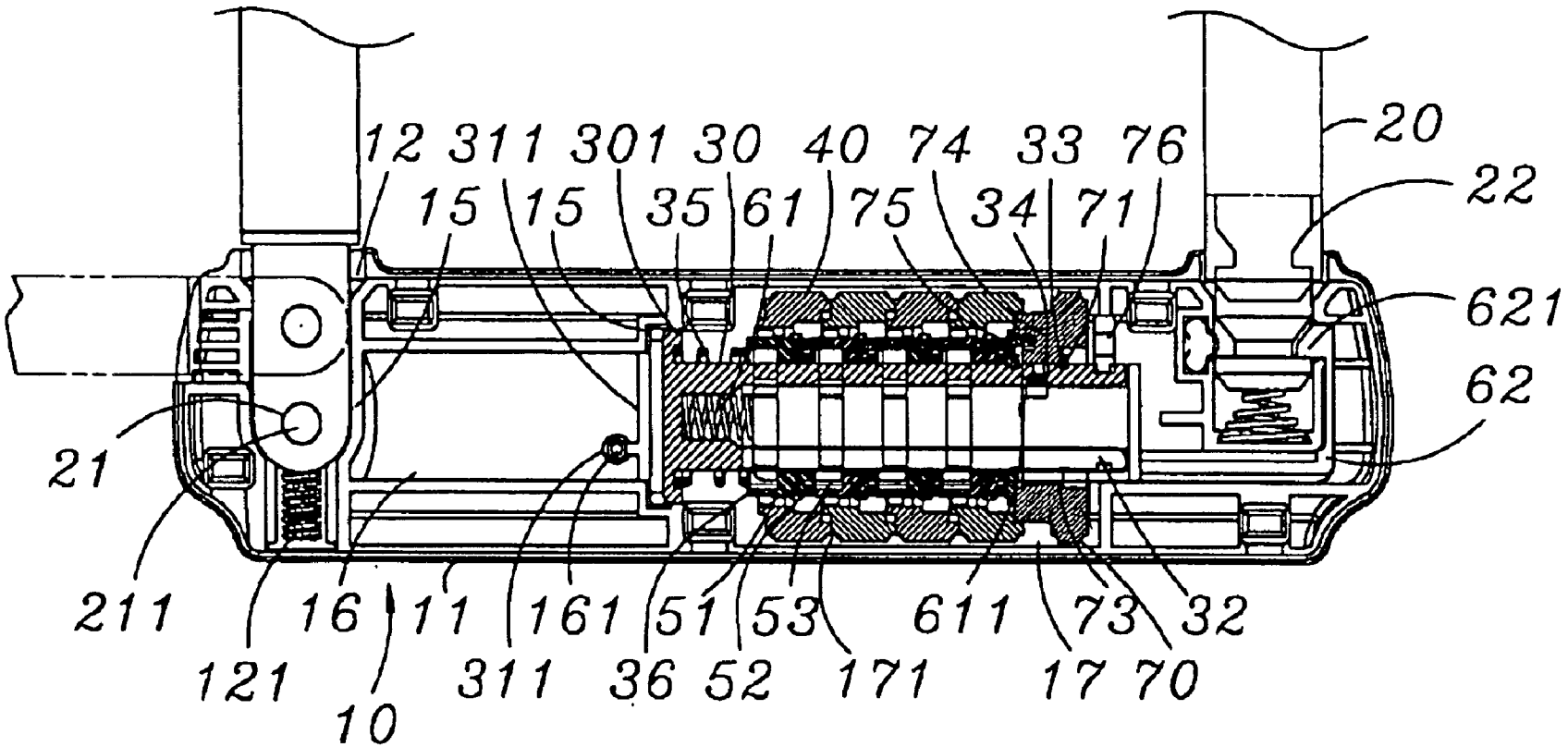
FIG. 3 is a schematic drawing of the cross-sectional view of the assembled present invention.
Figure 4:
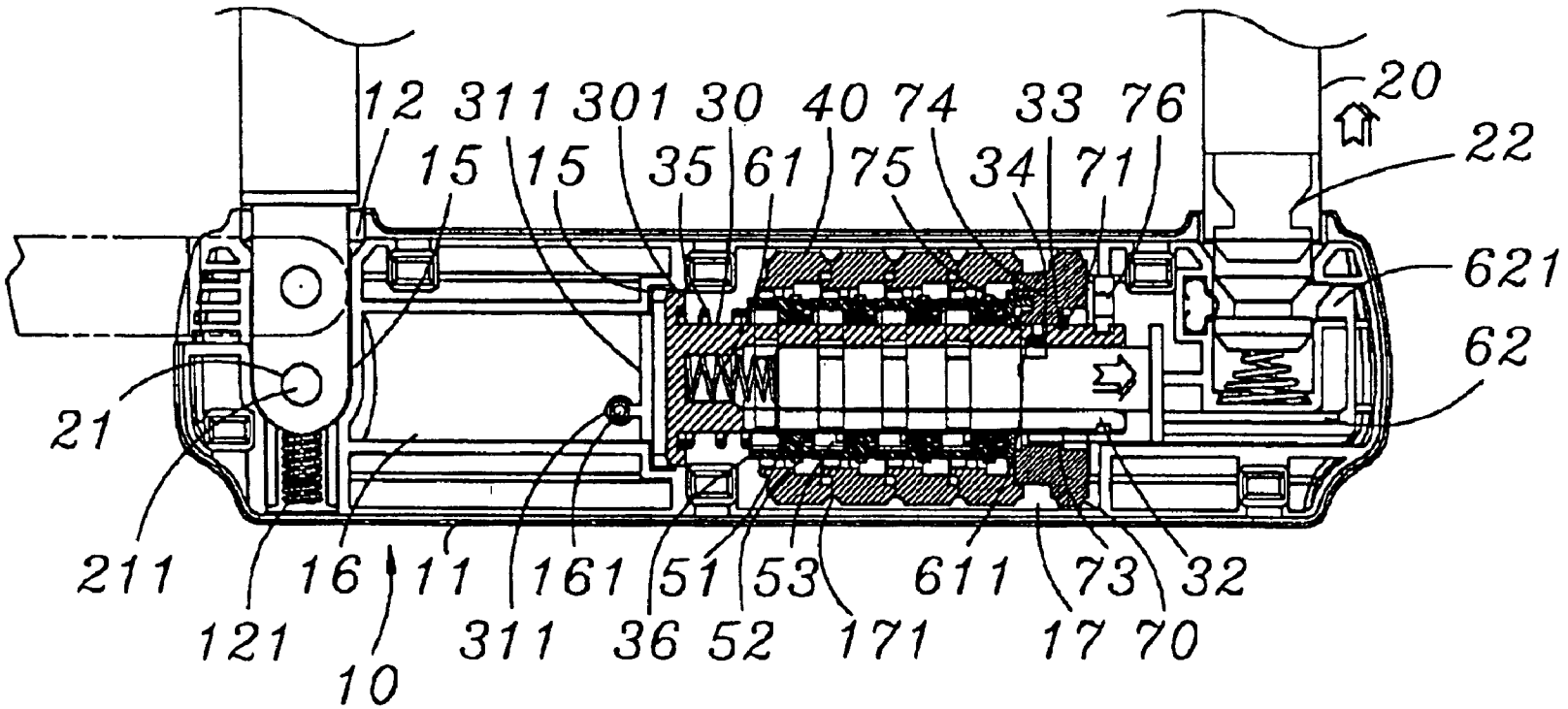
FIG. 4 is a schematic drawing of the action of releasing a lock bar of the present invention.
Figure 5:
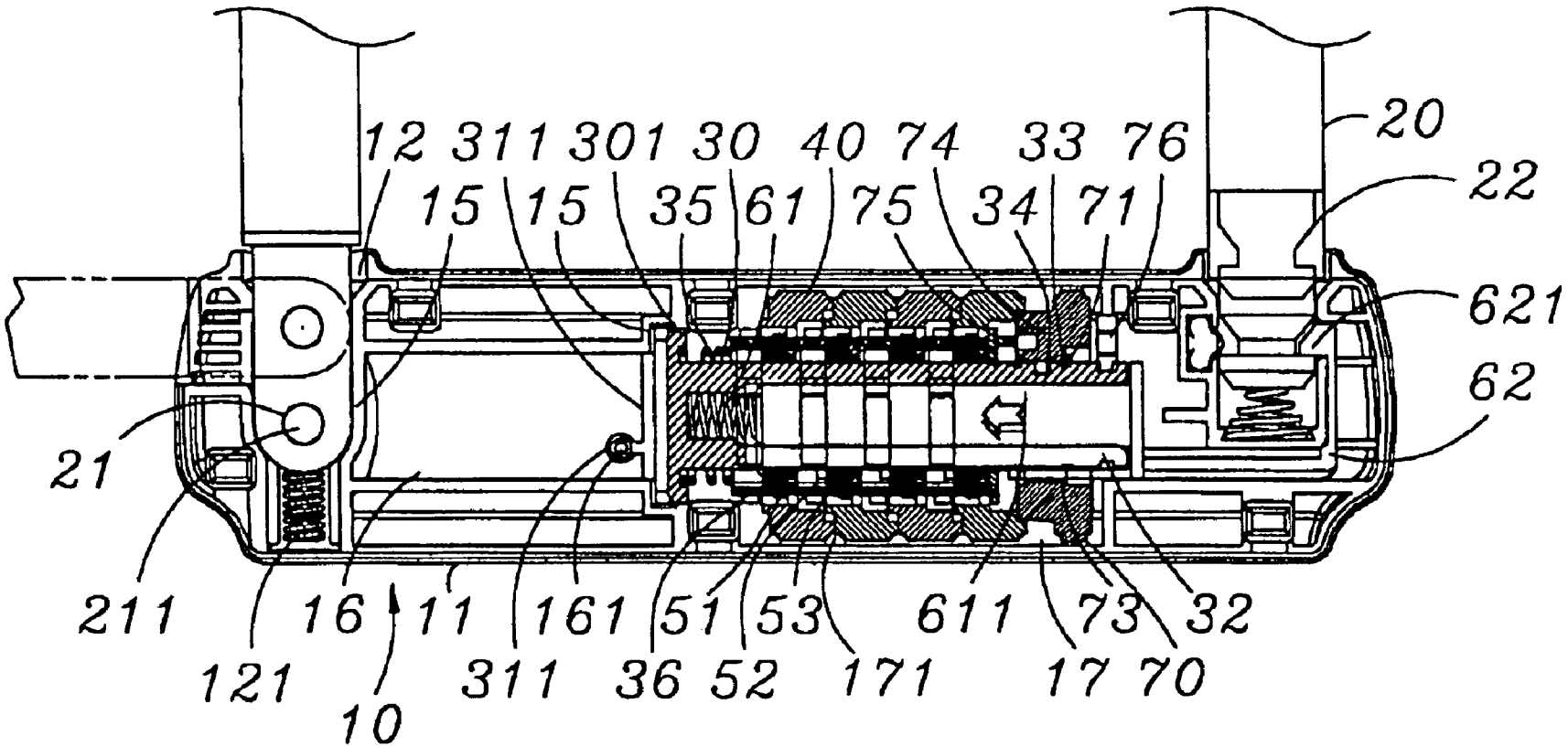
FIG. 5 is a schematic drawing of the locking action of the present invention.
Figure 6:
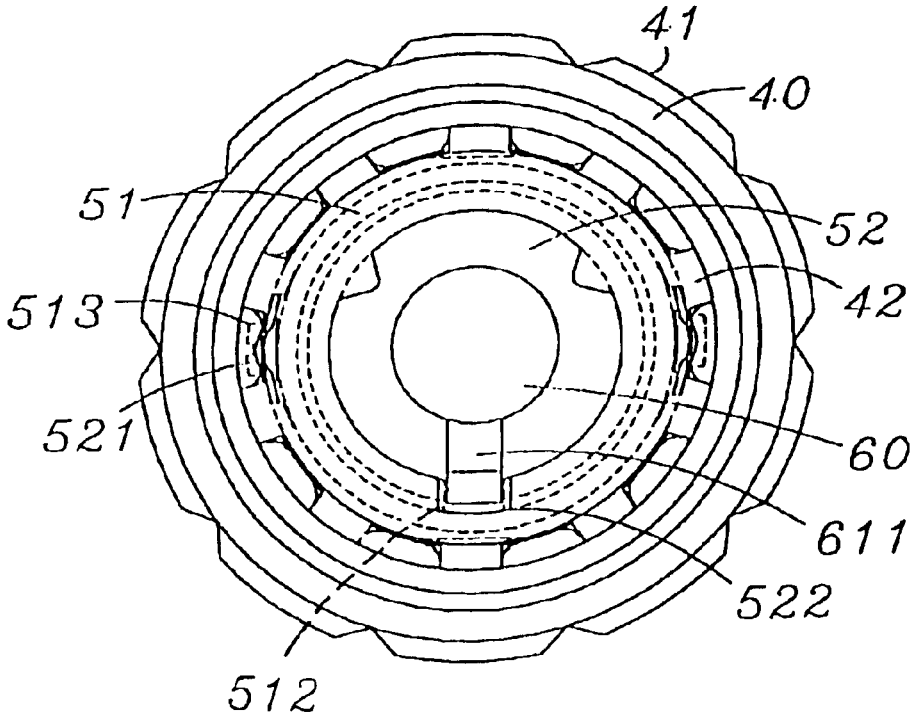
FIG. 6 is the first schematic drawing of the action of the cut surface of a digit wheel of the present invention.
Figure 7:
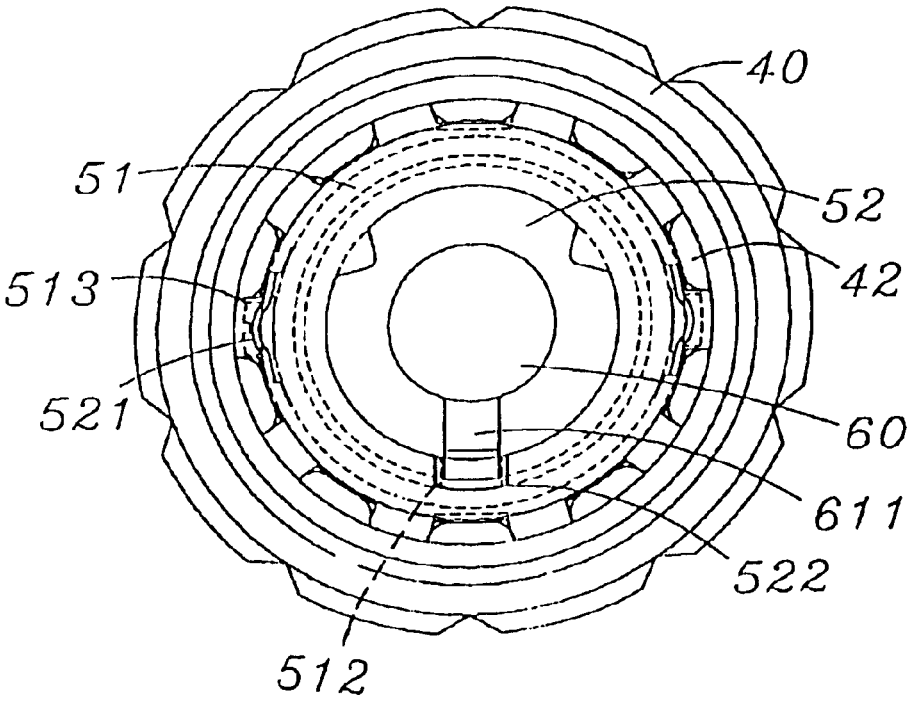
FIG. 7 is the second schematic drawing of the action of the cut surface of a digit wheel of the present invention.

When in use, referring to FIGS. 1, 2, 3, 4, 5, 6 and 7, first the digit wheel (40) is rotated to the preset digit (41) to align the locating point (513) of the locating seat (51) and the resilient retainer (521) on the live ring (52) such that the locating seat (51) and the live ring (52) are slidable along to the concave groove (42) opposite the preset digit (41) and the slide slot (512) on the locating seat (51) opposite the locating step (611) of the lock bolt (60). Then the mark (72) on the retaining ring (70) is rotated to align with the preset digit (41) in one straight line, thereby to make the notch (73)of the retaining ring (70) opposite the locating step (611) of the lock bolt (60). After that, the end of the lock bar (20) not pivotally jointed with the lock body (10) is inserted in the lock hole (13) to press and force the lock bolt (60) to smoothly slide passing the notch (73) and the slide slot (512). The digit wheel (40) drives the locating seat (51) to interact with the locating step (611) on the lock bolt (60) and moves the lock bolt (60), thereby moving the lock bolt (60) in a direction towards the sleeve (30). As the lock bolt is moving toward the convex ear (31) of the sleeve (30), the retaining member (75) on the retaining ring (70) is pressed and forced by the actuating member (74) to disengage the actuating member (74) and to press toward the locating seat (51), so as to press the said locating seats (51) to separate from the digit wheel (40). After that, the digit wheel (40) and the retaining ring (70) are rotated at will, as shown in FIGS. 3, 5 and 7; therefore, under the blocking of the locating seat (51), the lock bolt (60) does not tend to move outwards;

furthermore, the retaining hook (621) of the retaining member (62) just retains onto the insert slot (22) of the lock bar (20) and the setting action is thereby accomplished.

On the contrary, if trying to disengage one end of the lock bar (20) from the lock hole (13), it is only necessary to rotate the set digit (41) of the digit wheel (40) to a certain position, then rotate the mark (72) on the retaining ring (70) to align with the preset digit (41) in one straight line to make the notch (73) of the retaining ring (70) opposite the locating step (611) of the lock bolt (60); therefore, the lock bolt (60) moves toward the outside of the sleeve (30) to make the locating seat (51) move along back to the original position and further make the retaining hook (621), retained on the insert slot (22) of the lock bolt (20) and of the retaining member (62), separate from the lock bar (20), thereby unlock the lock, as shown in FIGS. 3, 4 and 6.

The mentioned embodiment of the present invention is only an exemplary description of one of the feasible implementations of the present invention, those who are skilled in this art might be able to conduct various changes for the detail shapes with equal efficiency; however, those changes should be included in the spirit and the scope of the present invention.

What is claimed is:

1. A changeable combination lock comprising:

a lock body having opposite end portions, each opposite end portion having a lock hole;

a lock bar having two ends inserted into the lock holes of the lock body;

a hollow sleeve fixed inside the lock body, the sleeve having an open slot extending axially therethrough;

a plurality of digit wheels rotatably sleeved around an outer surface of the sleeve, surfaces of said digit wheels having consecutive digits, each digit having a concave groove;

a plurality of actuating members clamped between the sleeve and the digit wheels, the digit wheels control rotation and setting of the actuating members, each of the plurality of actuating member having a slide slot on a locating seat;

an elongated lock bolt having a first end portion within the hollow sleeve, the lock bolt including a plurality of locating steps fitting in the digit wheels, said locating steps protruding outwardly from the sleeve through the open slot; a resilient element acting between said lock bolt and a closed end of the sleeve; the lock bolt having a second end portion with a retainer member extending into one of the lock holes, the retaining hook engaging one end of the lock bar;

a retaining ring rotatably sleeved on the hollow sleeve adjacent to one of the lock holes, the retaining ring including a mark disposed on a peripheral surface; and an axial notch corresponding to the said mark within the retaining ring; an actuating member inserted on an inner lateral rim of the retaining ring facing an adjacent digit wheel; a retaining member retaining on the actuating member;

whereby when in use, the digit wheels are rotated to set a desired combination, the mark of the retaining ring is aligned with the digit wheels in a straight line, thereby aligning the concave groove of each digit wheel opposite the preset digit and the slide slot on the locating seat opposite the locating step of the lock bolt and aligning the notch of the retaining ring opposite the locating step of the lock bolt, when the retaining ring is rotated, the lock bolt being moved through the digit wheels in a first direction to separate the actuating members from the digit wheels such that digit wheels are freely rotatable to change the combination, and moving the lock bolt in a second direction to re-engage the actuating members with the digit wheels to set the combination.

* * * * *